US010390391B2

(12) United States Patent
Liu et al.

(10) Patent No.: US 10,390,391 B2
(45) Date of Patent: Aug. 20, 2019

(54) DRIVER FOR A LIGHT EMITTING DIODE (LED) LIGHTING SYSTEM

(71) Applicant: General Electric Company, Schenectady, NY (US)

(72) Inventors: Zhichao Liu, Shanghai (CN); Ling He, Shanghai (CN)

(73) Assignee: General Electric Company, Schenectady, NY (US)

( * ) Notice: Subject to any disclaimer, the term of this patent is extended or adjusted under 35 U.S.C. 154(b) by 0 days.

(21) Appl. No.: 14/901,539

(22) PCT Filed: Jun. 26, 2014

(86) PCT No.: PCT/US2014/044364
§ 371 (c)(1),
(2) Date: Dec. 28, 2015

(87) PCT Pub. No.: WO2014/210324
PCT Pub. Date: Dec. 31, 2014

(65) Prior Publication Data

US 2016/0165686 A1 Jun. 9, 2016

(30) Foreign Application Priority Data

Jun. 28, 2013 (CN) ..... 2013 1 0303589

(51) Int. Cl.
*H05B 33/08* (2006.01)

(52) U.S. Cl.
CPC ..... *H05B 33/0815* (2013.01); *H05B 33/0845* (2013.01)

(58) Field of Classification Search
CPC ..... H05B 33/0818; H05B 33/0815
USPC ..... 326/291; 315/291
See application file for complete search history.

(56) References Cited

U.S. PATENT DOCUMENTS

| | | | | |
|---|---|---|---|---|
| 2007/0290625 | A1* | 12/2007 | He | H02M 3/3385 315/274 |
| 2010/0244726 | A1* | 9/2010 | Melanson | H02M 3/33523 315/291 |
| 2012/0056551 | A1* | 3/2012 | Zhu | H02M 1/4258 315/232 |
| 2012/0229041 | A1 | 9/2012 | Saes | |
| 2012/0286684 | A1 | 11/2012 | Melanson | |
| 2012/0286696 | A1 | 11/2012 | Ghanem | |
| 2013/0049589 | A1* | 2/2013 | Simi | H05B 33/0815 315/85 |

(Continued)

FOREIGN PATENT DOCUMENTS

| | | |
|---|---|---|
| CN | 201509348 U | 6/2010 |
| CN | 202738194 U | 2/2013 |

OTHER PUBLICATIONS

PCT Search Report issued in connection with corresponding Application No. PCT/US2014/044364 on Sep. 19, 2014.

(Continued)

*Primary Examiner* — Don P Le
(74) *Attorney, Agent, or Firm* — Wood IP LLC

(57) ABSTRACT

Provided is a lighting system driver including a damper circuit. A power circuit is coupled to the damper circuit and includes a first portion of a winding of a transformer. Also included is an oscillating control circuit including a second portion of the winding of the transformer.

11 Claims, 4 Drawing Sheets

(56) References Cited

U.S. PATENT DOCUMENTS

| | | | | |
|---|---|---|---|---|
| 2013/0057167 | A1* | 3/2013 | Angeles | H05B 33/0842 315/200 R |
| 2013/0119884 | A1* | 5/2013 | Hung | H05B 33/0854 315/219 |
| 2013/0162156 | A1* | 6/2013 | Sutardja | H05B 33/0842 315/201 |
| 2014/0132179 | A1* | 5/2014 | McAuliffe | H02M 3/156 315/291 |
| 2016/0172981 | A1* | 6/2016 | Gritti | H02M 3/33507 363/21.12 |
| 2017/0027029 | A1* | 1/2017 | Hu | H05B 33/0815 |

OTHER PUBLICATIONS

Machine translation and a copy of Chinese Office Action issued in connection with Corresponding CN Application No. 201310303589.8 dated Jul. 17, 2017.

* cited by examiner

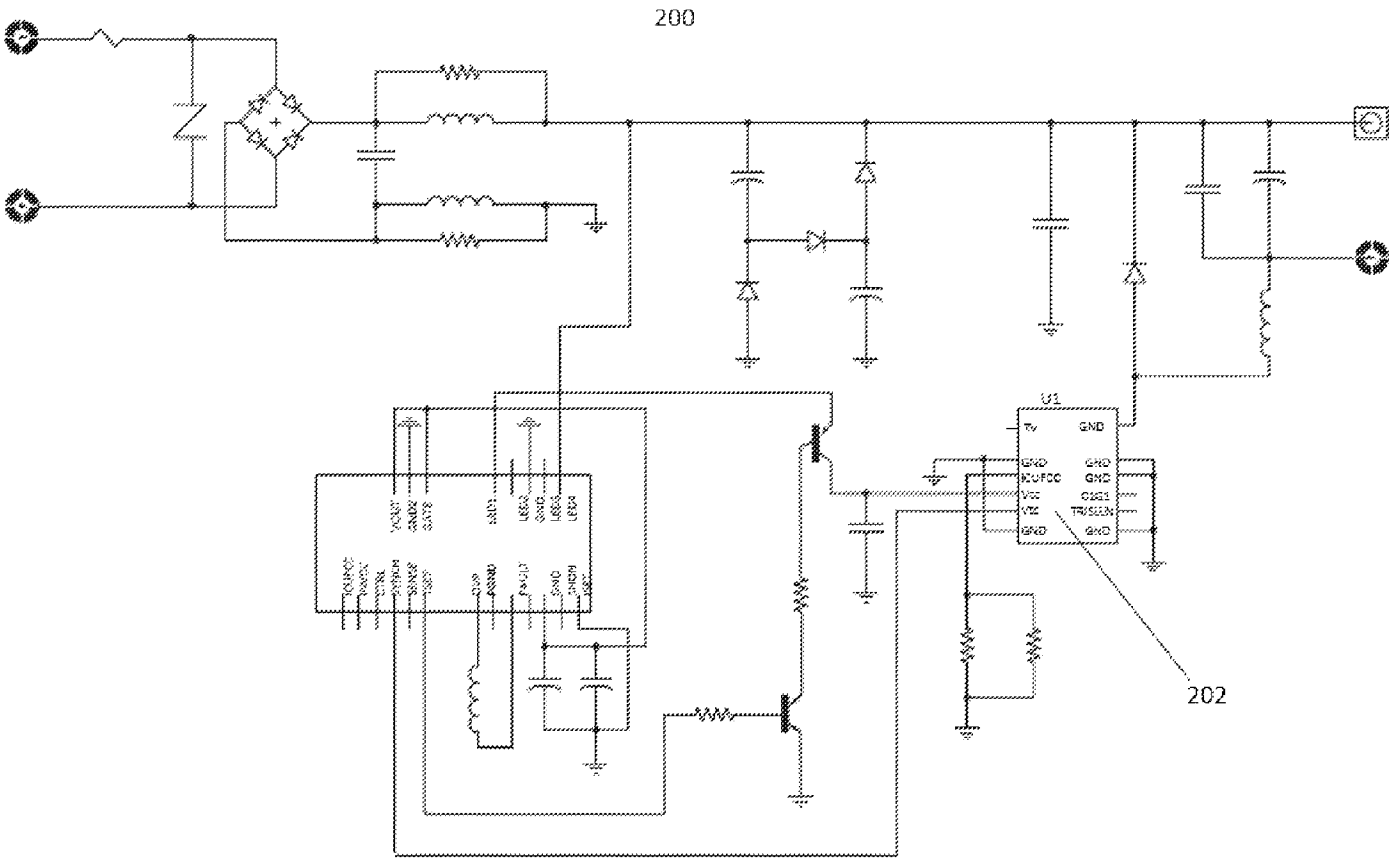
FIG. 2
(conventional)

DRIVER FOR A LIGHT EMITTING DIODE (LED) LIGHTING SYSTEM

FIELD OF THE INVENTION

The present invention relates generally to lighting systems. More particularly, the present invention relates to dimming systems for LED lighting system drivers.

BACKGROUND OF THE INVENTION

LED lighting systems are becoming increasingly popular as the cost of LEDs drops due to manufacturing efficiencies. These LED lighting systems typically utilize a plurality of connected LEDs to produce a desirable light output intensity and brightness. In many cases, because of better power efficiency and much longer lifetime, existing lighting fixtures are being retrofitted to accommodate LEDs as replacements. By way of example, many incandescent lighting systems have been retrofitted to use LEDs.

While LEDs are being used as replacements in existing lighting systems, as in the case of incandescent lighting systems, most customers desire the same features in LED lamps that are provided in the incandescent systems. One such feature is an ability to dim the light to provide proper ambience and energy savings. LEDs, however, generally cannot be directly connected to conventional dimming circuits. For example, an LED driver directly connected to a conventional dimmer cannot easily and efficiently operate at lower dimming levels, or could be damaged by current spikes. Therefore, a number of conventional approaches have been devised to provide a dimming capability designed specifically for LED lighting systems.

Many of the conventional dimming systems and techniques include the use of an integrated circuit (IC) to provide a control signal for power switching and current regulation. These control ICs, however, can be expensive and can require complex control strategies. Also, most dimming control ICs require additional power switches to provide adequate bleeding and/or damping. ICs can therefore be problematic.

SUMMARY OF THE EMBODIMENTS OF THE INVENTION

Given the aforementioned deficiencies, a need exists for LED dimming methods and systems eliminate the requirement of control ICs.

In at least one aspect, embodiments of the present invention provide a lighting system dimming driver including a damper circuit. A power circuit is coupled to the damper circuit and includes a first portion of a winding of a transformer. Also provided is an oscillating control circuit, including a second portion of the winding of the transformer.

The embodiments provide a low cost switching mode power electronic converter for use in an LED driver to facilitate dimming. A transformer having an auxiliary winding in its primary winding stage is used. Using a transformer having an auxiliary winding, along with several passive components, the driver's converter can be self-oscillated. This self-oscillating feature eliminates the need for an IC to provide a control signal for power switching the device.

Additionally, embodiments of the present invention can operate well with most dimmers (e.g., phase cut), including leading/trailing/smart dimmers, as well as many other type dimmers. A high power factor and higher operational efficiency can be achieved at relatively low costs.

Further features and advantages of the invention, as well as the structure and operation of various embodiments of the invention, are described in detail below with reference to the accompanying drawings. It is noted that the invention is not limited to the specific embodiments described herein. Such embodiments are presented herein for illustrative purposes only. Additional embodiments will be apparent to persons skilled in the relevant art(s) based on the teachings contained herein.

BRIEF DESCRIPTION OF THE DRAWINGS

The accompanying drawings, which are incorporated herein and form part of the specification, illustrate the present invention and, together with the description, further serve to explain the principles of the invention and to enable a person skilled in the relevant art(s) to make and use the invention.

FIG. 2 is a schematic illustration of a conventional LED dimming circuit.

DETAILED DESCRIPTION OF THE EMBODIMENTS

The following detailed description is merely exemplary in nature and is not intended to limit the applications and uses disclosed herein. Further, there is no intention to be bound by any theory presented in the preceding background or summary or the following detailed description.

Throughout the application, description of various embodiments may use "comprising" language, however, it will be understood by one skill in the art, that in some specific instances, an embodiment can alternatively be descried using the language "consisting essentially of" or "consisting of."

For purposes of better understanding the present teachings and in no way limiting the scope of the teachings, it will be clear to one skill in the art that the use of the singular includes the plural unless specifically stated otherwise. Therefore, the terms "a," "an" and "at least one" are used interchangeably in this application.

Figure 1:
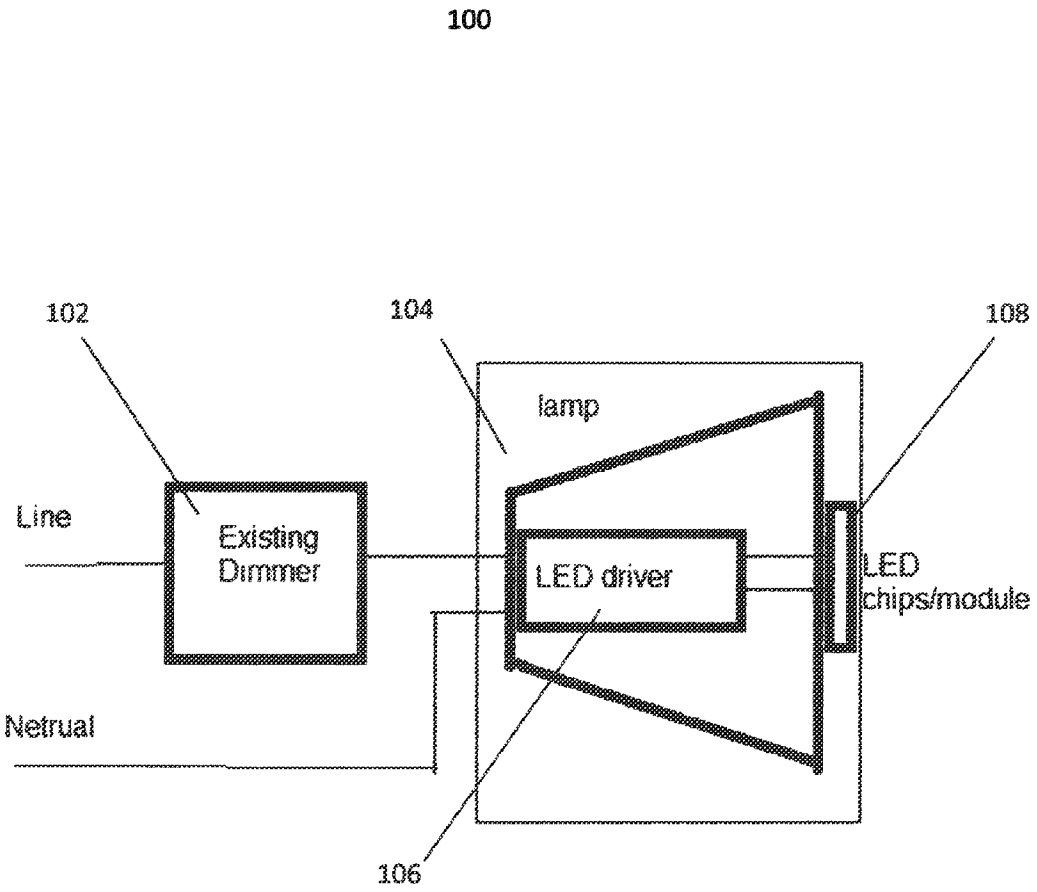
FIG. 1 is an illustration of a dimmer control system in which embodiments of the present invention can operate.

FIG. 1 is an illustration of a lighting control system 100 in which embodiments of the present invention can be practiced. The lighting control system 100 includes an existing dimming module 102 for controlling dimming. The dimming module 102 is connected to an LED lamp assembly 104, including a driver 106 for controlling an LED lighting array 108. The dimming module 102 and the LED driver 106 enable a user to adjust the intensity of the LED lighting array 108 to an optimal level.

FIG. 2 is a schematic diagram illustration of a conventional LED dimming circuit 200. The conventional LED dimming circuit 200 can be included, for example, in a lighting assembly, such as the lamp 104 of FIG. 1. In addition to power circuitry, bleeding circuitry, damping, etc., the LED driver circuit 200 includes a microprocessor-based control IC 202 that provides a control signal for power switching and dimming control. As noted above, will control ICs, along with the additional needed components, can be quite expensive.

Embodiments of the present invention provide methods and systems to control dimming without the need for a control IC. Additionally, drivers constructed in accordance with the embodiments are compatible with existing dimmers.

Figure 3:
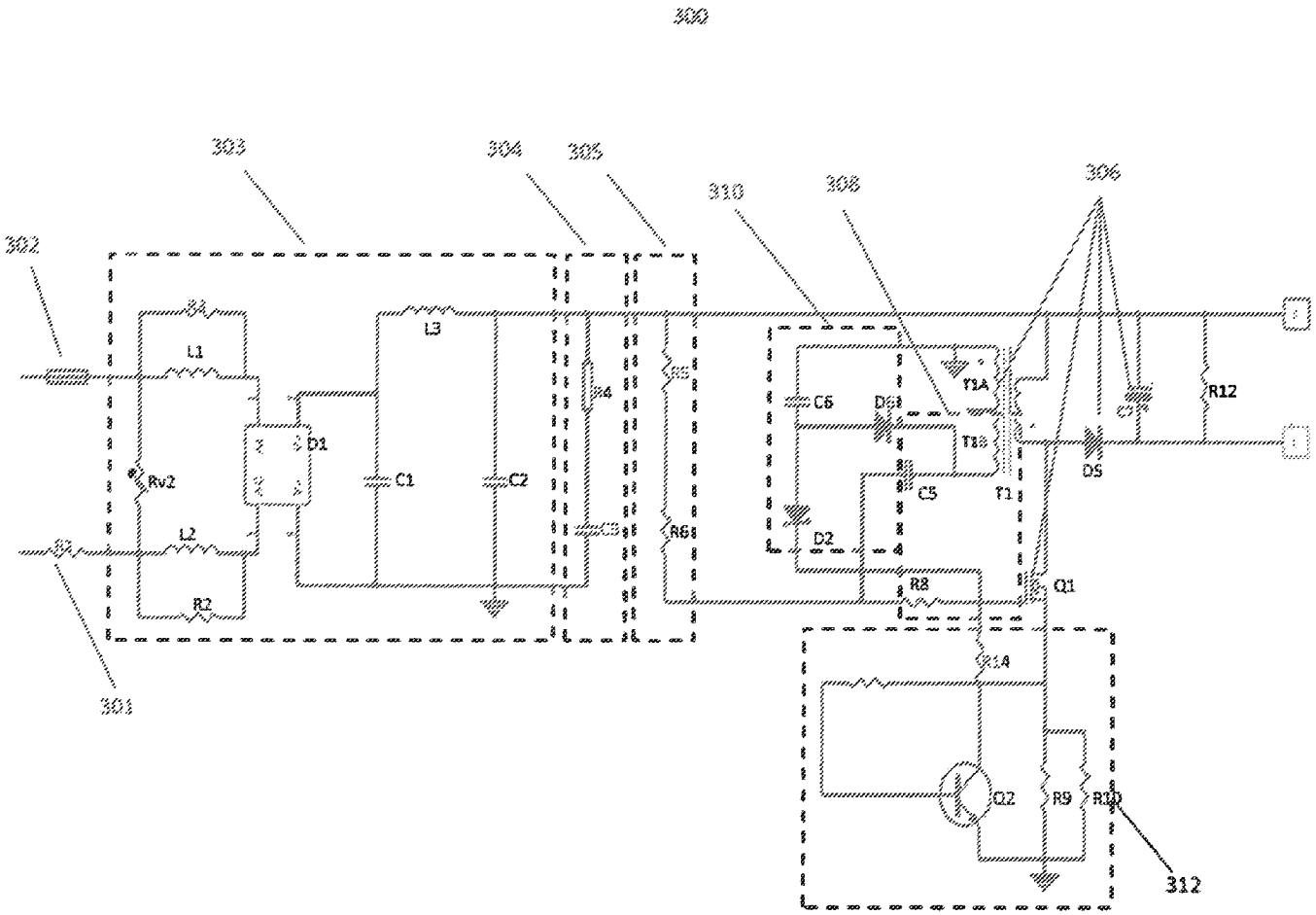
FIG. 3 is a schematic illustration of an exemplary LED driver constructed in accordance with the embodiments.

FIG. 3 is a schematic diagram illustration of an exemplary LED driver circuit 300 constructed in accordance with the embodiments. The LED driver circuit 300 can be included, for example, within the lamp 104, as illustrated in FIG. 1. Alternatively, the LED driver circuit 300 can be constructed within an independent housing in case.

The driver circuit 300 provides a dimming feature and includes discrete electronics to provide on and off switching. For example, the driver circuit 300 includes a low cost switching mode power electronic converter (discussed below), along with a transformer that has an auxiliary winding. Other passive components are included that enable the driver circuit 300 to be self-oscillating.

By way of example, and not limitation, the driver circuit 300 includes a critical conduction mode and is compatible with most single switch power converters. For example, the driver circuit 300 can be used with buck-boost, flyback, and a number of other converter configurations.

An optional resistor 301 (R1) is depicted in the driver circuit 300. The optional resistor 301 can be used for damping current in the driver circuit 300. A fuse (e.g., fuse resistor) 302 provides a safety component for disconnecting the LED driver 300 from a main power source during a fault condition.

The dimming circuit 300 also includes an electromagnetic interference (EMI) and rectifier circuit 303. The circuit 303 includes discrete components such as inductors L1, L2, and L3, capacitors C1 and C2, and a rectifier D1. In the exemplary circuit 300, and by way of example and not limitation, the rectifier D1 is implemented as a bridge diode. As understood by those of skill in the art, however, the rectifier could be implemented via number of other suitable approaches. In the embodiments, EMI filter and rectifier circuit 303 provides smoothing and alternating current (AC) to direct current (DC) conversion.

A circuit segment 304 includes a resistor R4 and a capacitor C3. In the embodiments, R4 and C3 are used for dimming application, can passively damp current ringing (i.e. restrain peak current), and provide a bleeding path when the dimming function is activated. The circuit segment 304 also provides a level of compatibility between the driver and the dimmer. A circuit segment 305 forms an optional starting resistor and includes resistors R5 and R6.

Within the exemplary driver circuit 300, a main power segment 306 is provided, and implemented in the form of a buck-boost converter. As noted above, however, other converter types can be used. The main power segment 306 includes a metal oxide semiconductor field effect transistor (MOSFET) Q1 to provide switching.

Although the transistor Q1 is implemented as a MOSFET, other transistor types could be used, such as bipolar junction transistors (BJTs). The main power stage 306 includes a main winding T1A of transformer T1, a diode D5, and a capacitor C7. The main winding T1A of the transformer T1 serves as an inductor and the main stage of the power segment 306.

The capacitor C7 (e.g., an electrolytic capacitor) is also used to form part of an output stage of the driver circuit 300 and is provided to smooth the voltage. A resistor R12 provides a dummy load for the driver circuit 300.

An oscillating control circuit 308 plays a fundamental role in the self-oscillation feature discussed above. The oscillating control circuit 308 includes an auxiliary winding T1B of the transformer T1. The auxiliary winding T1B is used to control transistor Q1 by turning the transistor on and off. As illustrated, the transformer T1 includes two windings, T1A and T1B, as part of its primary winding stage. The oscillating control circuit 308 also includes a capacitor C5 and a resistor R8. The auxiliary winding T1B, along with the capacitor C5 and the resistor R8, causes the driver circuit 300 to oscillate.

A circuit segment 310 includes a capacitor C6, a diode D6, and a diode D2 (e.g., a zener). The circuit segment 310 provides overvoltage protection.

Finally, a circuit segment 312 provides current sensing and limits peak current. The circuit segment 312 includes a transistor Q2, along with resistors R9, R10, R13, and R14.

Figure 4:
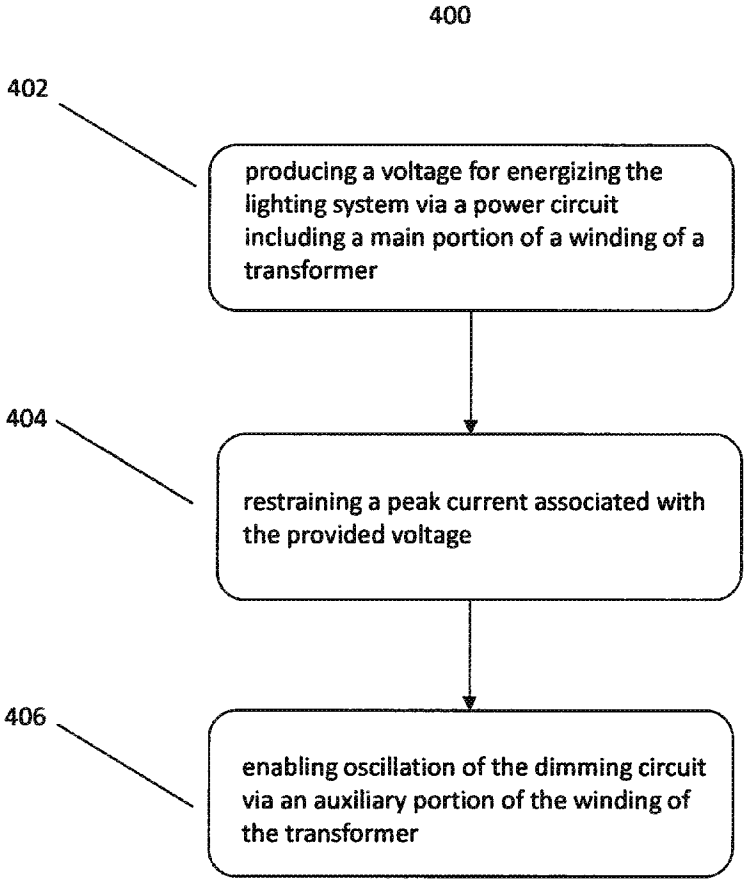
FIG. 4 is a flowchart of an exemplary method of practicing an embodiment of the present invention.

FIG. 4 is a flowchart of an exemplary method 400 of practicing an embodiment of the present invention. In block 402, a voltage is produced for energizing a lighting system via a power circuit. The power circuit also includes a main portion of a winding of a transformer. Block 404 restrains a peak current associated with the provided voltage. In block 406, an oscillation feature associated with the dimming circuit, is enabled via an auxiliary portion of the winding of the transformer.

Alternative embodiments, examples, and modifications which would still be encompassed by the disclosure may be made by those skilled in the art, particularly in light of the foregoing teachings. Further, it should be understood that the terminology used to describe the disclosure is intended to be in the nature of words of description rather than of limitation.

Those skilled in the art will also appreciate that various adaptations and modifications of the preferred and alternative embodiments described above can be configured without departing from the scope and spirit of the disclosure. Therefore, it is to be understood that, within the scope of the appended claims, the disclosure may be practiced other than as specifically described herein.

What is claimed is:

1. A lighting system driver compatible with, and configured to be connected to, a dimmer external to the lighting system driver, the driver comprising:

a damper circuit configured to damp current ringing;

a power circuit coupled to the damper circuit, the power circuit comprising:

a transformer including:

a primary winding configured to receive power from the damper circuit, the primary winding having (i) a main winding and (ii) an auxiliary winding; and a secondary winding configured to receive power from the primary winding and transfer the received power to a phase-cut dimmer;

a main power segment including the main winding of the primary winding, the secondary winding, and a switching transistor configured to provide switching for the secondary winding; and a passive oscillating control circuit coupled to the switching transistor and including the auxiliary winding of the transformer;

wherein:

the passive oscillating control circuit is configured to oscillate the switching transistor on and off; and the driver is devoid of an integrated circuit (IC) controller.

2. The lighting system driver of claim 1, wherein the transistor is a metal oxide semiconductor field effect transistor.

3. The lighting system driver of claim 1, wherein the damper circuit is passive.

4. The lighting system driver of claim 3, wherein the damper circuit is configured to restrain peak current.

5. The lighting system driver of claim 4, wherein restraining the peak current facilitates dimming.

6. The lighting system driver of claim 5, wherein the damper circuit includes a capacitor and a resistor.

7. The lighting system driver of claim 1, further comprising an open circuit protection block including one or more diodes coupled to the second winding.

8. The lighting system driver of claim 1, wherein the passive oscillating control circuit further comprises a capacitor, wherein the auxiliary winding and the capacitor are configured to cause oscillation of the driver.

9. A light emitting diode driver, comprising:

a transformer including a primary winding configured to receive power, the primary winding having (i) a main winding and (ii) an auxiliary winding; and a secondary winding configured to receive power from the primary winding and transfer the received power to an output light emitting diode (LED);

a main power segment including the main winding of the primary winding, the secondary winding, and a switching transistor coupled to the main winding of the switching transformer transistor and configured to provide switching for the secondary winding; and and a passive oscillating control circuit (i) coupled to the switching transistor, (ii) including the auxiliary winding of the transformer (iii) and configured to control the transistor;

wherein the driver is devoid of an integrated circuit (IC) controller: and wherein the driver is compatible with and configured to be connected to a dimmer.

10. The light emitting diode driver of claim 9, further including a passive damper circuit configured to (i) restrain peak current or damp current ringing and (ii) deliver power to the primary winding.

11. The emitting diode driver of claim 9, wherein the passive oscillating control circuit further comprises a capacitor, wherein the auxiliary winding and the capacitor are configured to cause oscillation of the driver.

* * * * *